United States Patent [19]

Spies et al.

[11] Patent Number: 4,703,693

[45] Date of Patent: Nov. 3, 1987

[54] APPARATUS FOR CONTROLLING A WEAPON, ESPECIALLY A DROPPABLE BOMB

[75] Inventors: Hans Spies, Pfaffenhofen; Alfons Woehrl, Schrobenhausen, both of Fed. Rep. of Germany

[73] Assignee: Messerschmitt-Boelkow-Blohm Gesellschaft mit beschraenkter Haftung, Munich, Fed. Rep. of Germany

[21] Appl. No.: 888,824

[22] Filed: Jul. 22, 1986

[30] Foreign Application Priority Data

Jul. 24, 1985 [DE] Fed. Rep. of Germany ..... 3526474

[51] Int. Cl.[4] ..... F42C 11/00

[52] U.S. Cl. ..... 102/215; 102/200; 102/427

[58] Field of Search ..... 102/215, 216, 206, 200, 102/426, 427

[56] References Cited

U.S. PATENT DOCUMENTS

| | | | |
|---|---|---|---|
| 4,254,475 | 3/1981 | Cooney et al. | 102/215 |
| 4,375,192 | 3/1983 | Yates et al. | 102/215 |
| 4,388,867 | 6/1983 | Baumer | 102/216 |
| 4,398,466 | 8/1983 | Sepp et al. | 102/427 |
| 4,586,436 | 5/1986 | Denney et al. | 102/206 |
| 4,638,130 | 1/1987 | Groessler et al. | 200/61.45 |

FOREIGN PATENT DOCUMENTS

| | | | |
|---|---|---|---|
| 2752823 | 5/1979 | Fed. Rep. of Germany | 102/427 |
| 2207557 | 11/1982 | Fed. Rep. of Germany . | |
| 3436397 | 5/1985 | Fed. Rep. of Germany | 102/216 |

*Primary Examiner*—Charles T. Jordan

*Attorney, Agent, or Firm*—W. G. Fasse; D. H. Kane, Jr.

[57] ABSTRACT

A weapon control for a droppable weapon such as a bomb, has at least two sensors for producing impact related or environment related signals for a microcomputer forming part of the weapon. The microcomputer evaluates the signals received from the sensors for producing different control signals for different situations as signified by the sensor produced signals. If the weapon has hit a hard target surface the responsive control signal detonates the weapon instantly. If the weapon got stuck in a soft target, the weapon is placed into a lurking state for a later detonation or defusing.

11 Claims, 5 Drawing Figures

FIG. 2
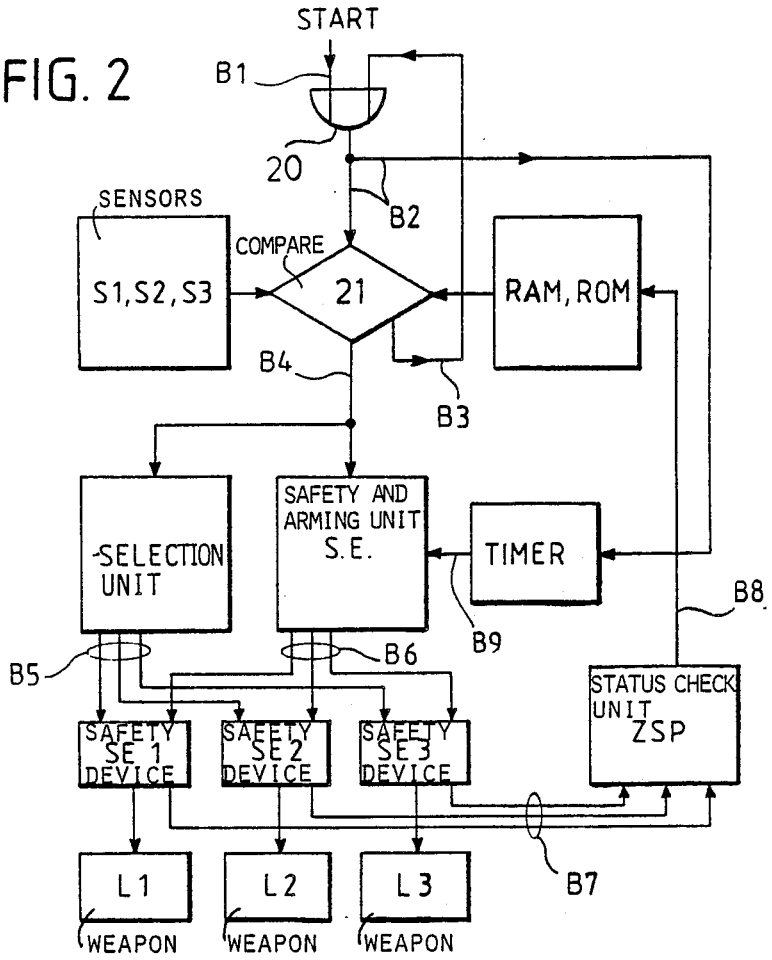
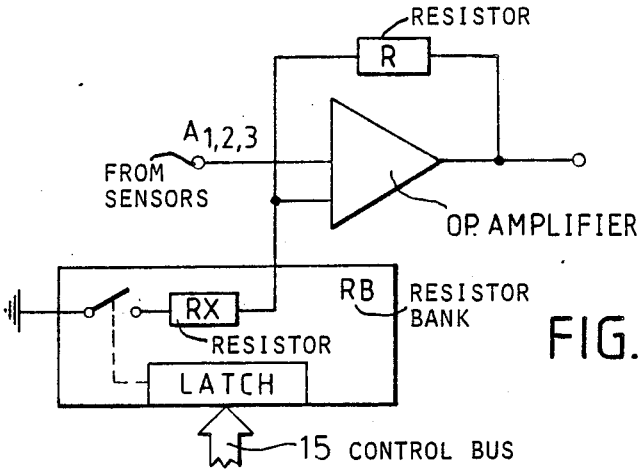
FIG. 3

APPARATUS FOR CONTROLLING A WEAPON, ESPECIALLY A DROPPABLE BOMB

FIELD OF THE INVENTION

The invention relates to an apparatus for controlling a weapon, especially a droppable bomb which may comprise one or more explosive charges. It shall be possible to control the operation of the weapon in response to conditions prevailing at the target and/or in the environment of the target. Sensors sense these conditions and supply respective signals to an ignition circuit.

DESCRIPTION OF THE PRIOR ART

German Patent (DE-PS) No. 2,207,557 discloses a hollow charge mine suitable for multiple purposes. When the mine is dropped from an aircraft the effective direction of its hollow charge is directed toward a target against which the mine is to be used. The mine comprises a primary sensor system which responds to the kind of target after the weapon has been positioned on the ground. The prior art mine also comprises at least one secondary sensor system which becomes effective when the mine directly hits a target. The primary sensor system enables the prior art mine to be placed into a lurking state after it has been dropped from an aircraft. Such a mine is suitable for combating vehicles made of metal. However, the prior art mine is not suitable for targets such as bridges, troop shelters, roads and runways.

U.S. Ser. No. 662,089 filed Oct. 18, 1984, now U.S. Pat. No. 4,638,130, issued Jan. 20, 1987, relates to a method and apparatus for detecting different detonating conditions for a follow-up charge. U.S. Ser. No. 662,089 is based on German Serial No. P 33 38 784. According to U.S. Pat. No. 4,638,130 the triggering conditions for igniting the follow-up charge are sensed by two sensors. One sensor has a relatively coarse acceleration sensitivity. The other sensor has a fine acceleration sensitivity. When such a weapon is dropped from an aircraft it is able to determine at the time of hitting a target, whether it should explode right away or whether it should assume a lurking state, depending on the type of target that has been hit, for example, depending on the type of cover a certain shelter may have.

German Patent Publication No. P 34 36 397 describes a method and apparatus for triggering a follow-up charge in response to signals received from two acceleration sensors, one of which is less sensitive than the other. The sensors establish the triggering conditions for the follow-up charge. The sensors permit a precise determination of a direction reversal on impact and of the firing point from the impact condition. Such a weapon can be used in the present context.

When a weapon of this kind is deflected from a hard surface without exploding the explosive charge, the body of the explosive charge is generally damaged substantially. In such a situation, it becomes necessary to rapidly decide at the time of target impact, whether the weapon should be exploded instantly, or whether it should be placed into a lurking state. The decision depends on the conditions prevailing at the target and such decision must be made as rapidly and as precisely as possible. It has been found that prior art systems employing displacement and/or mass sensors are rather slow in their response at least under certain circumstances. Additional sensors are required if the prior art weapons are to be placed into a lurking state for detecting an approach to the weapon.

For mining and destroying of public roadways, shelters, and airport runways, several types of weapons are used in increasing numbers. Such weapons include those which can be dropped from an aircraft, those which are ballistically fired from a barrel or launcher and those equipped with their own power plant. Such weapons are intended for penetrating into a target, thereby using their kinetic energy. Such penetration is important because the maximum effect depends on a certain penetration depth. If the weapon rebounds upon hitting a target because the target surface condition causes such a rebound, then a substantial reduction in the effectiveness of the weapon results or the weapon fails altogether.

OBJECTS OF THE INVENTION

In view of the foregoing it is the aim of the invention to achieve the following objects singly or in combination:

to provide an apparatus for controlling a weapon or mine which is equipped for assuming a lurking state, in such a way that the conditions which characterize a target are rapidly and precisely evaluated when the weapon hits a target for producing a control signal which either detonates the weapon, or places the weapon into a lurking state or which even diffuses the weapon;

to provide an apparatus of the type described which produces the control signal in a microcomputer by comparing sensor received target specific signals with signal reference information stored in the memory of the computer;

to minimize the number of required sensors and the components required for the signal processing;

to control the sensitivity of the sensors with the aid of the microcomputer; and to select from a plurality of effective explosives that one which is particularly suitable for the type of target hit by the weapon.

SUMMARY OF THE INVENTION

According to the invention the weapon is equipped with at least one deformation sensor which is integrated into the weapon for sensing a deformation of the weapon upon target impact, and at least one status change sensor such as an acceleration sensor for producing a respective status change signal. The output signals of the sensors are supplied to a microcomputer having one or more random access memories and/or read-only memories with a fixed or a variable memory content for the purpose of a time and amplitude evaluation of the sensor signals. The time evaluation involves a frequency check. The microcomputer further compares the sensor signals which are weapon relevant signals with each other and/or with the signal reference information such as signal patterns in the computer memory or memories. The comparing takes place in accordance with a fixed program sequence or in accordance with a program sequence which is selectable prior to becoming effective as a program sequence.

It is advantageous to control or adjust the sensitivity of the sensors by signals from the microcomputer. A further sensor, such as a microphone may be used for sensing environmental conditions at the location of the weapon, for example, when the latter is in a lurking state. Further, in those instances where the weapon is equipped with several types of effective means such as different explosive charges, it is possible to select, by the computer, that type of effective means which is particularly suitable for the target involved. Such weapon or effective means selection is responsive to sensor signals reflecting a target characterization or acquisition and a target classification.

The computer may also develop a control signal which either detonates the weapon after a certain time delay, or which defuses the weapon.

BRIEF DESCRIPTION OF THE DRAWINGS

In order that the invention may be clearly understood, it will now be described, by way of example, with reference to the accompanying drawings, wherein:

FIG. 2 is an operational flow diagram of the apparatus of FIG. 1;

FIG. 3 shows a circuit for controlling the sensitivity of the sensors of FIG. 1 in response to a computer program;

DETAILED DESCRIPTION OF PREFERRED EXAMPLE EMBODIMENTS AND OF THE BEST MODE OF THE INVENTION

Figure 1:
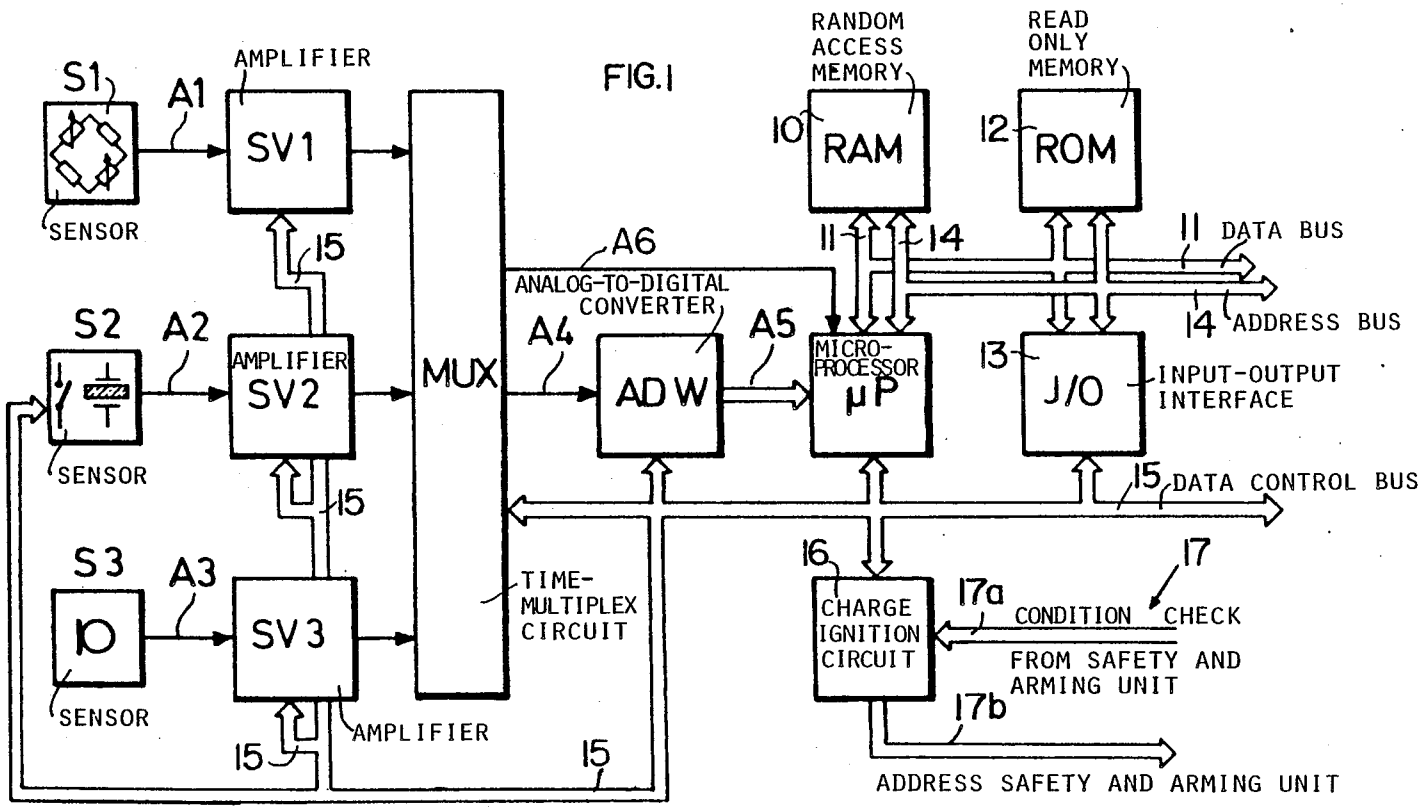
FIG. 1 is a block diagram of the present weapons control apparatus.

The system shown in FIG. 1 illustrates a computer controlled sensor system comprising a status sensor and, if desired, an environmental sensor. The status sensor comprises two sensor elements S1 and S2. The sensor element S1 is a deformation sensor such as a strain gage bridge circuit which is integrated into the weapon structure not shown in FIG. 1. The sensor element S2 responds to status changes and may, for example, be an acceleration sensor. The third sensor S3 may, for example, be a microphone which monitors the environment of the weapon after it has reached its target.

The outputs of the sensors S1, S2, and S3 are connected through respective output conductors A1, A2, and A3 to respective signal processing circuits SV1, SV2, and SV3. A multiplexing circuit MUX is connected to the outputs of the signal processing circuits SV1, SV2, and SV3. The multiplexing circuit MUX has a sensor signal output A4 which is connected through an analog-to-digital converter ADW which in turn is connected through a databus line A5 to the microcomputer or microprocessor $\mu$P. A further output A6 of the signal multiplexer MUX is also connected to the microcomputer for the purpose of sensing a signal overflow in the MUX circuit avoiding time delay in the ADW circuit for the decision of gain control in the SV1, SV2 and SV3 circuits.

The microcomputer is linked to a random access memory 10 through a databus 11 which also links a read-only memory 12 to the microcomputer $\mu$P and to an interface circuit 13. The random access memory 10, the read-only memory 12, the interface circuit 13, and the microcomputer $\mu$P are also linked with one another through an address bus 14. Further, the microcomputer $\mu$P is linked through a control signal bus 15 to the interface circuit 13, to the analog-to-digital converter ADW, to the time multiplex circuit MUX, to the signal processing circuits SV1, SV2, and SV3, and to at least one of the sensors such as the sensor element S2 or to all of the sensor elements. Additionally, the microcomputer $\mu$P is linked through the control signal bus 15 to an ignition circuit 16 which is further connected through a radio link 17 to a transmitter receiver not shown.

The microcomputer $\mu$P evaluates the signals received from the sensors to determine whether the weapon has been rebounded from a target or whether the weapon is stuck in a target. Thus, the computer can determine whether or not an instantaneous detonation of the weapon should be caused, for example, in response to a rebound or when it is intended to destroy the weapon.

On the other hand, when the weapon is stuck in a target the computer will, in response to its program sequence, place the weapon into a lurking state. For this purpose the microcomputer activates the sensor S3 through its signal processing circuit SV3. As mentioned, the sensor S3 may, for example, be a microphone to sense noise in the environment of the weapon. The sensor S3 may also be a light sensor or a magnetic sensor. The microcomputer $\mu$P compares the signals received from the sensor S3 with signal reference information stored in the memories. Thus, the microcomputer $\mu$P is enabled to classify the target characteristics and to select in response to such characteristics a suitable effective means, such as a particular type of charge. Following a certain time delay which is computer controlled, the weapon can be defused or detonated to destroy it.

The content of the memories 10 and 12 may either be a fixed content or it may be a variable content. The program sequence may be hard wired into the system or it may be variable in response to the sensed signals, or even in response to data inputs prior to the firing or dropping of the weapon.

The deformation sensor element S1 is installed in a suitable location inside the weapon. The deformation may, for example, be sensed by the above mentioned strain gage elements arranged in a bridge circuit or so-called compression responsive elements located inside the housing of the weapon. Similarly, the deformation sensor element S1 may comprise a capacitor which changes its capacity in response to deformation. The signals appearing at the outputs A1, A2 and A3 are linearized and any offset values are compensated in response to the program control, by the data processing circuits SV1, SV2, and SV3.

The acceleration sensor S2 is, for example, a piezoelectric sensor which is controlled by the microcomputer.

Generally, it may be sufficient to use just the sensors S1 and S2 for providing a rapid and highly sensitive recognition of the impact conditions with a high resolution including a target characterization which might call for placing a weapon into a lurking state. By adding the third sensor, for example, in the form of a microphone, it is possible to determine what type of target is to be attacked or destroyed when the weapon is in its lurking state.

The signals on the outputs A1, A2, and A3 are compared by the microcomputer with regard to their time, that is, with regard to their frequency and their amplitudes with reference to signal reference information stored in the memories. Such signal reference information is obtained from prior tests which provide the acceleration and deformation forces depending on the type of target hit by the weapon. Such reference information is then stored in the memories 10 and 12 and thus assures a very rapid signal processing. As a result, when the weapon hits a target with a hard surface characteristic, an instantaneous triggering of the weapon is possible so that the weapon can develop its largest effect prior to being mechanically destroyed or prior to any rebound. When the weapon assumes a lurking function because it got stuck, the signal preparing provides an exact target characterization, whereby a weapon which carries a plurality of effective means such as different types of charges, can be triggered by selecting the most effective charge with regard to the particular target involved.

A special advantage of the apparatus according to the invention is seen in that the rebound characteristic of a weapon from a target can be ascertained more precisely and more rapidly than heretofore due to the frequency and amplitude signal comparing. Heretofore, it was possible to compare the sensor signals only with threshold values. According to the invention an entire signal pattern resulting from the sensors is compared with signal patterns providing a reference information stored in the memories.

The circuit blocks SV1, SV2, and SV3 are adjustable preamplifiers for adjusting the signals coming on conductors A1, A2, and A3 from the respective sensors S1, S2, and S3. The operation of these preamplifiers may include limiting the respective signal to a predetermined value. FIG. 3 shows an example embodiment of these preamplifiers as will be described in more detail below.

The time multiplexing circuit MUX is of conventional construction and supplies the signals from the preliminary amplifiers SV1, SV2, and SV3 to the microprocessor $\mu$P in response to instructions received on the control databus 15, whereby the sequence of signal transmission is determined by a freely selectable program stored in the read only memory 12. The signals coming from the time multiplexer MUX are supplied by the conductor A4 to the analog-to-digital converter ADW and through the databus A5 to the microcomputer $\mu$P. A further conductor A6 connects the time multiplexer MUX to the microcomputer to control overflow. This control makes sure that signals that are too large, from the sensors S1, S2, and S3 are not supplied to the analog-to-digital converter ADW. Thus, in response to a signal on the conductor A6 the microcomputer $\mu$P will reduce the amplification of the preamplifiers SV1, SV2, or SV3 through an instruction signal on the control databus 15.

The arrows at the right-hand ends of the databus 11 and of the address bus 14, as well as at the control bus 15 merely indicate that the present circuit may be connected in parallel to further circuits of the same kind or that, as needed, additional random access memories and read only memories may be provided. The interface block 13 is a conventional input output control circuit for controlling the priority of the several databus lines 11, 14, and 15. The microcomputer $\mu$P can be any conventional computer having the required bit capacity. Word length in the range of four to thirty-two bits has been found to be suitable.

The ignition circuit 16 also includes the charge or charges and the radio link 17 connects the unit 16 to conventional safety devices not shown. The unit 16 can send signals on the link 17*b* to a safety and arming unit. The unit 16 receives condition check signals from the safety and arming unit on the link 17*a*. The connection to the data bus 15 provides the signals for timing the ignition and for the selection of any one of a plurality of charges forming part of the unit 16.

The third sensor S3 in FIG. 1 is switched into an operational state in accordance with the program stored in the memory 12 and in response to sensing conditions of the first and second sensors S1 and S2 providing merely noise signals. If the third sensor S3 then detects a signal, the first two sensors may be further used by an adjustment of the sensitivity of the first sensors to a higher or lower level in response to a signal received from the third sensor. Incidentally, any signal comparing is performed by conventional signal comparing circuits forming part of the microcomputer.

The flow diagram of FIG. 2 explains the function of the microcomputer shown in FIG. 1. A start signal B1 is supplied through an OR gate 20 providing an input signal B2 to the comparing means 21 and to a timer. The comparing circuit 21 in the computer also receives signals from the sensors S1, S2 and S3 as well as from the random access memory 10 and the read only memory 12. Depending on the measured and stored signals a decision is made at 21 whether an intended target is present or not. If the target is not an intended target, an output signal B3 is provided to repeat the signal comparing in a lurking state. However, if an intended target has been detected, a respective instruction signal B4 is provided to a selection unit and to a weapon arming unit SE. The selection of the desired weapon is accomplished by providing a signal B5 and the arming is accomplished by providing a signal B6. The signal B6 depends on the timer signal B9. Safety devices SE1, SE2, and SE3 receive the selection signal B5 and the arming signal B6 for selecting and arming the respective load L1 or L2 or L3 or any combination thereof. An output signal B7 from the safety devices is supplied through a status check unit ZSP which provides a respective output signal B8 to the memories of the computer. Thus, the proper operating status of the safety devices SE1, SE2, and SE3 is continuously checked. The respective status check is stored in the memory. As mentioned, the timer provides a signal B9 which enables the arming of the respectively selected load after a preselectable time period. This time period may be set to cause the weapon to self-destruct.

FIG. 3 illustrates the content of the preamplifiers SV1, SV2, and SV3. Each of these circuits includes an operational amplifier, the amplification of which is adjustable by the proper selection of the ratio of the resistors R and RX. The required or suitable resistor RX is selected from a plurality of resistors in a resistor bank RB. This selection is made by a signal on the control databus 15 for latching a respective resistor RX into the circuit, for example by closing a contact.

Figure 4:
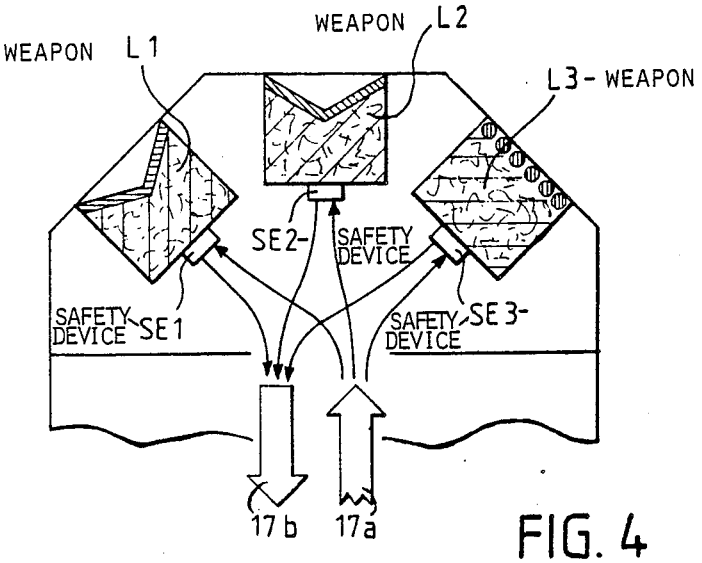
FIG. 4 shows a weapon having several effective means such as different types of charges which are utilized selectively by the present computer in accordance with the particular target characteristics.

FIG. 4 shows further details of the unit 16 of FIG. 1 including three loads L1, L2, and L3 as well as a respective safety device SE1, SE2, and SE3 connectable to the bus lines or conduits 17*a* and 17*b* which may be radio links or light conducting fibers.

Figure 5:
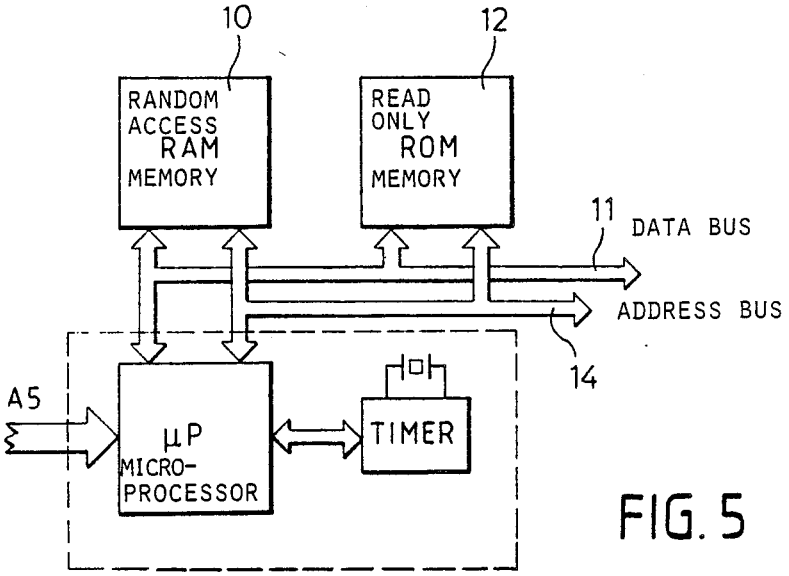
FIG. 5 illustrates a computer control time delay circuit for triggering or for defusing the weapon.

FIG. 5 illustrates that the microcomputer $\mu$P has an internal clock signal generator or timer. The program stored in the memory ROM employs a certain time period provided by the timer for checking the safety devices SE1, SE2, and SE3 through the control bus or conduit 15. If the required conditions prevail, the load or loads will be ignited or fired. If the conditions are not present, the weapon may be disarmed again, whereby the program provides the required decision and the programming will depend on the type of weapon and the type of application, for example, in friendly or foe territory.

Although the invention has been described with reference to specific example embodiments, it will be appreciated, that it is intended to cover all modifications and equivalents within the scope of the appended claims.

What we claim is:

1. An apparatus for controlling a weapon, comprising sensor means in said weapon for providing a plurality of weapon relevant signals, said sensor means comprising a first sensor (S1) integrated into said weapon for sensing a deformation of said weapon when said weapon contacts a surface to provide a first weapon relevant signal, a second sensor (S2) installed in said weapon for sensing a status change of said weapon to provide a second weapon relevant signal, said first and second weapon relevant signals providing conditions which characterize a target, a microcomputer ($\mu$P) including memory means having signal reference information stored therein for evaluating said first and second weapon relevant signals to provide a target characteristic for producing a weapon control signal, signal processing means (SV1, SV2, MUX) connected to said sensor means and to said microcomputer for supplying said first and second weapon relevant signals to said microcomputer for said evaluating, signal comparing means in said microcomputer for comparing said first and second weapon relevant signals, and program means in said microcomputer for controlling said evaluating including said comparing of said first and second weapon relevant signals in said signal comparing means with regard to a plurality of signal characteristics including signal frequency (time) and amplitude for producing said weapon control signal in response to said first and second weapon relevant signals in accordance with said target characteristic.

2. The apparatus of claim 1, wherein said signal reference information stored in said memory means comprise fixed signal patterns.

3. The apparatus of claim 1, wherein said signal reference information stored in said memory means comprise variable signal patterns.

4. The apparatus of claim 1, wherein said microcomputer means comprise program varying means for selecting or varying said program means prior to a program sequence.

5. The apparatus of claim 1, wherein said signal comparing means compare said first and second weapon relevant signals with each other in response to said program means with regard to frequency (time) and amplitude.

6. The apparatus of claim 1, wherein said signal comparing means compare said first and second weapon relevant signals with said signal reference information with regard to frequency (time) and amplitude.

7. The apparatus of claim 6, wherein said signal reference information comprises a predetermined signal pattern or patterns previously established in a test.

8. The apparatus of claim 1, wherein said second sensor is an acceleration sensor for sensing said status change.

9. The apparatus of claim 1, wherein said first and second sensors have an adjustable sensitivity, and wherein said microcomputer comprises means for adjusting the sensitivity of at least one of said sensors.

10. The apparatus of claim 1, comprising at least one further sensor for sensing physical conditions in the environment of said weapon to provide a third weapon relevant signal, means operatively connecting said computer means to said further sensor means for activating said further sensor means when said weapon is in a lurking state.

11. The apparatus of claim 10, wherein said microcomputer produces said weapon control signal in response to said first, second, and third weapon relevant signals.

* * * * *